United States Patent [19]

Wylie

[11] Patent Number: 4,915,294

[45] Date of Patent: Apr. 10, 1990

[54] SYSTEM FOR MONITORING AND EQUALIZING TEMPERATURE IN MULTI-STORY BUILDINGS

[75] Inventor: Calvin R. Wylie, Fair Oaks, Calif.

[73] Assignee: Beutler Heating and Air Conditioning, Inc., Sacramento, Calif.

[21] Appl. No.: 345,728

[22] Filed: May 1, 1989

[51] Int. Cl.[4] ..... F24F 7/00

[52] U.S. Cl. ..... 236/49.3; 98/31.6

[58] Field of Search ..... 236/49.3; 98/34.5, 33.1, 98/31.5, 31.6

[56] References Cited

U.S. PATENT DOCUMENTS

| | | | |
|---|---|---|---|
| 2,235,620 | 3/1941 | Nessell | 236/11 X |
| 4,152,973 | 5/1979 | Peterson | 98/29 X |
| 4,184,415 | 1/1980 | Nicholson | 98/31.5 |

*Primary Examiner*—William E. Wayner

*Attorney, Agent, or Firm*—Thomas R. Lampe

[57] ABSTRACT

A system for lessening the temperature differential between the upper and lower levels of a building including sensing means for sensing the temperatures of both of said levels, air delivery means for delivering air between the level interiors, and control means for activating the air delivery means when a temperature differential of a predetermined magnitude is sensed by the sensing means.

7 Claims, 2 Drawing Sheets

SYSTEM FOR MONITORING AND EQUALIZING TEMPERATURE IN MULTI-STORY BUILDINGS

TECHNICAL FIELD

This invention relates to an apparatus and method for automatically equalizing the temperatures between lower and upper levels of a multi-story building. The arrangement disclosed herein has particular application in structural environments wherein it is desired to lessen the temperature differential between an upper level interior and a cooler lower level interior.

BACKGROUND ART

It is known in the art of building structure heating to propel air, as by means of a fan, from a lower level to an upper level. Known systems of this nature, however, are deficient in that they require either continuous fan operation, which utilizes excessive amounts of energy, or constant manual intervention, which is both inefficient and time consuming.

In contrast, the system of the present invention operates automatically to lessen the differential of temperatures in upper and lower building levels. The system operates by redistributing the hot air that normally rises to the upper levels of a multi-story building to a lower level, thereby providing a more uniform temperature throughout the building.

It will be appreciated that such redistribution saves energy since the occupant of the building need not over-heat the upper level in an attempt to properly heat the lower level. It is not uncommon for temperatures between levels of a multi-story building to reach differentials of 15 to 20 degrees Fahrenheit or more. An occupant can therefore waste a great deal of energy trying to heat a building lower level to a desired temperature.

The system of the present invention obviates these problems and difficulties in an efficient manner. The system functions only as necessary and when necessary, being activated only when the temperature differential between an upper level and a lower level exceeds a first predetermined magnitude. The system automatically shuts down when such temperature differential drops to a second predetermined magnitude.

DISCLOSURE OF THE INVENTION

Apparatus constructed in accordance of the teachings of the present invention is for use in a building including upper and lower levels, each level including a floor, a ceiling, and walls between the floor and ceiling to define an interior. The apparatus is adapted to lessen the temperature differential between the level interiors.

The apparatus includes duct means extending between the upper and lower levels and defining an air flow path between the upper and lower level interiors. First temperature sensing means senses the temperature of the lower level interior. Similarly, second temperature sensing means senses the temperature of the upper level interior.

Air delivery means is provided for delivering air between the upper level interior and the lower level interior through the flow path defined by the duct means.

Control means is included for activating the air delivery means when a temperature differential of a predetermined magnitude is sensed by the first and second sensing means. When activated, the air delivery means delivers air between the upper level interior and the lower level interior. The control means deactivates the air delivery means when a temperature differential of a lesser predetermined magnitude is sensed by the first and second sensing means.

Other features, advantages and objects of the present invention will become apparent with reference to the following detailed description and accompanied drawings.

DISCLOSURE OF THE INVENTION

Figure 1:
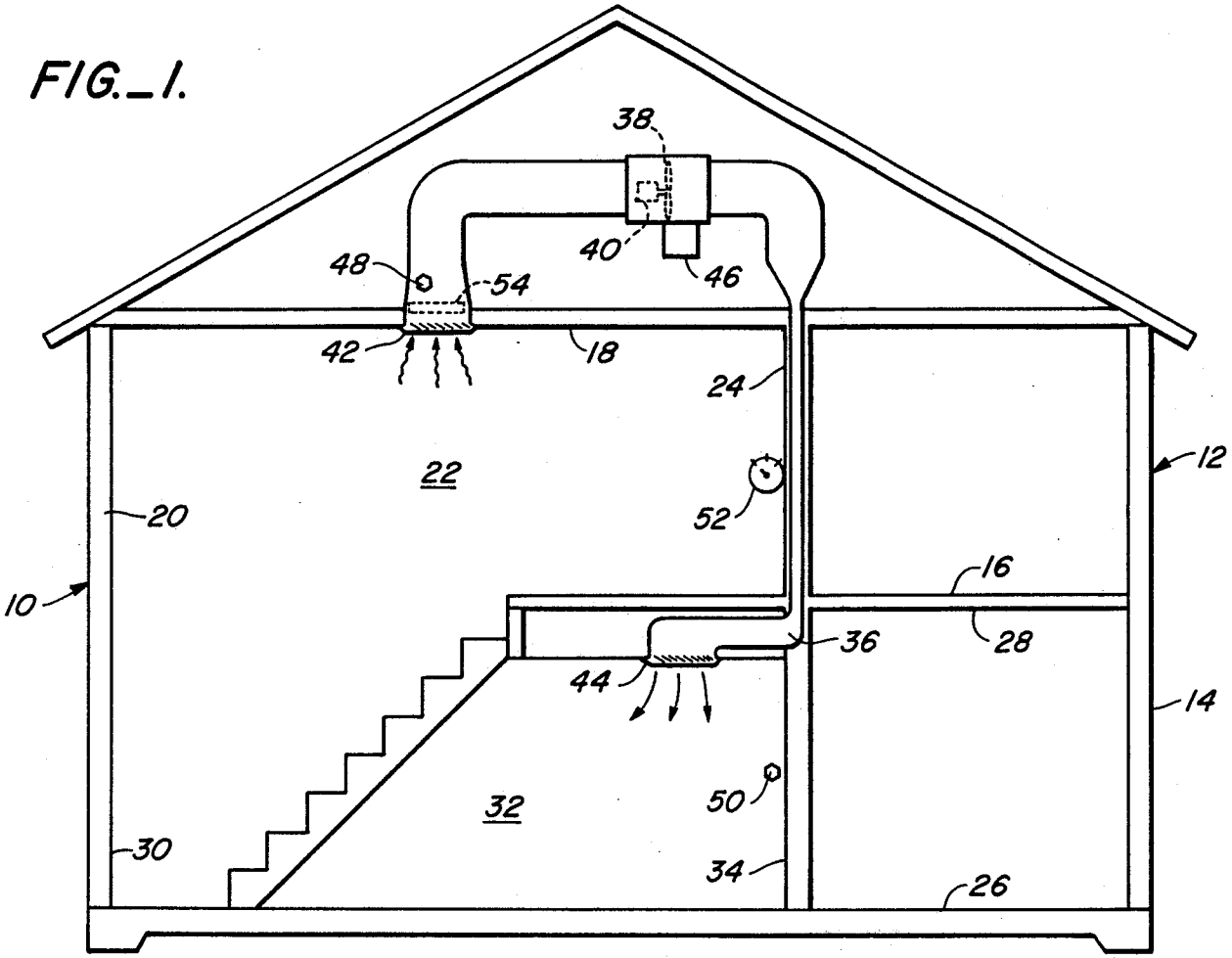
FIG. 1 is a diagrammatic side view of the inside of a multi-level building incorporating apparatus constructed in accordance with the teachings of the present invention.

Referring now to FIG. 1, a multi-story or multi-level building 10, which may be of any suitable construction, is illustrated. Building 10 includes an upper level 12 and a lower level 14. Upper level 12 includes, as is conventional, a floor 16, a ceiling 18, and walls, such as walls 20, 22 and 24 between the floor and ceiling to define a interior.

Similarly, lower level 14 includes a floor 26, a ceiling 28, and walls such as walls 30, 32, and 34 which define a lower level interior.

A duct 36 extends between the upper and lower levels and defines an air flow path between the upper and lower level interiors. The duct 36 may be of any suitable conventional type, as for example, sheet metal duct.

Air delivery means including a fan 38 is disposed within duct 36 in communication with the flow path defined thereby. A motor 40 of any conventional type is adapted to rotate the fan 38 when energized.

Duct 36 has an inlet end 42 which is located at the upper level ceiling 18 in communication with the upper level interior. The duct outlet end 44 is in communication with the interior of lower level 14. In the arrangement illustrated, the duct outlet end 44 is located at the upper extremity of the lower level 14 and spaced from wall 34.

Upon actuation of the motor 40, fan 38 will rotate and cause the passage of air within the duct 36. In FIG. 1, the fan 38 is considered to be rotating and air flow is, as shown by the arrows, from the duct inlet end 42 and out of the duct outlet end 44. Thus, the warmer air disposed at the ceiling of upper level 12 will be transported through the duct 36 into lower level 14.

Figure 2:
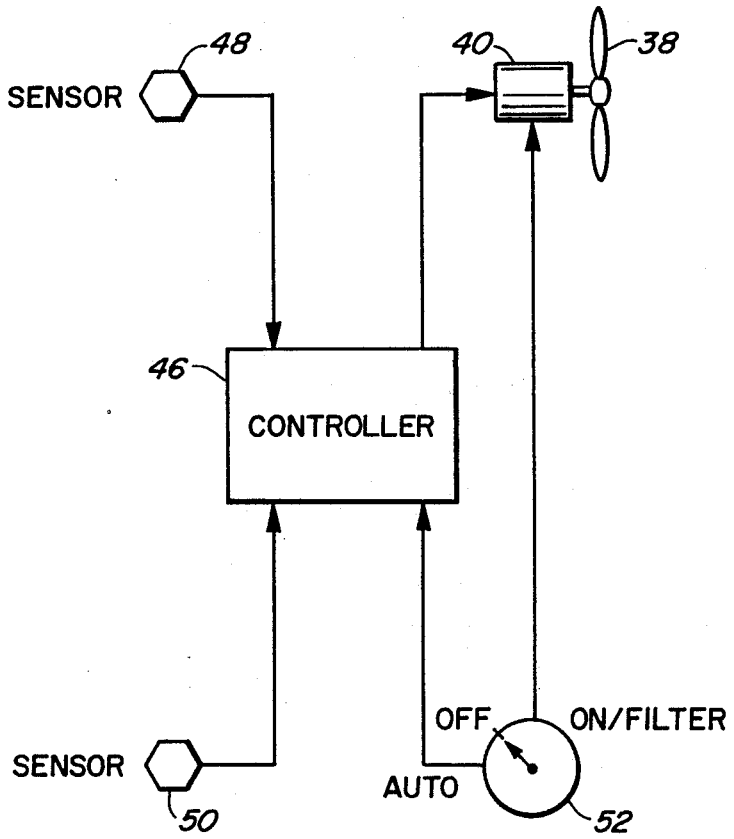
FIG. 2 is a schematic presentation of selected components of the apparatus and illustrating the cooperative relationship existing therebetween.

Referring now also to FIG. 2, the motor 40 is operatively associated with a controller 46 which, as is shown in FIG. 1, is preferably connected to the portion of the duct housing fan 38 and motor 40.

A suitable form of controller is a solar differential temperature control of a type normally used for domestic solar water installations. One such device is Model No. CM-33 made available by Independent Energy Inc. of East Greenwich, Rhode Island.

As shown in FIG. 2, controller 46 receives the inputs of two sensors 48, 50. The sensors 48, 50 may be of identical construction and each comprises a thermostat sensor of any suitable commercially available type. Sensor 48 is mounted at the duct inlet end 42, preferably within the interior of the inlet end. Sensor 50, on the other hand, is mounted in the lower level interior as, for example, upon wall 34. It should be noted that the sensor 50 is located adjacent the duct outlet end and spaced from the air stream exiting from the duct outlet end due to rotation of fan 38. This is to insure that sensor 50 maintains a more representative reading of the temperature of lower level 14.

A switch 52 is also in operative association with controller 46. The switch may be of any conventional type and, in the arrangement illustrated, the switch 52 has three positions. One position is the "off" position wherein there is no electrical connection to either the controller 46 or to motor 40.

When the switch 52 is switched to "auto" mode, controller 46 will be energized. In this mode, controller 46 is operative to energize motor 40 to turn fan 38 when the controller receives signals from sensors 48, 50 indicating that a temperature differential of a first predetermined magnitude exists between the upper level 12 and the lower level 14. In other words, when the upper level temperature exceeds the lower level temperature to a predetermined extent the controller 46 will function to energize the motor 40. When the difference between the sensed upper and lower level interior temperatures falls to a second (and obviously smaller) predetermined magnitude, the controller 46 will de-energize motor 40 and air flow through duct 36 will cease. This sequence will repeat itself, as necessary, depending upon the amount of heat required to heat the building, which affects the amount of air which is rising upstairs.

A suitable first predetermined temperature differential to initiate air flow movement is in the order of about 5 degrees Fahrenheit. A second predetermined temperature differential magnitude may be, for example, in the order of about 2 degrees Fahrenheit.

It should be noted that switch 52 also is capable of functioning in a third mode cooperation (that designated in FIG. 2 as "on/filter") in which the motor 40 is energized at all times until the switch 52 is either turned to the off mode or the auto mode.

Preferably, a filter 54, which may for example be an electrostatic air cleaner, is located within duct 36. One suitable location for the filter is just inside the return grill at the duct inlet end. By leaving the switch 52 at the on/filter position, air will be continuously circulated and purified within the building. This enables the filter 54 to remove pollen, mold spores, dust, dander, smoke and any other foreign particles residing therein.

I claim:

1. Apparatus for use in a building including lower and upper levels, each level including a floor, a ceiling, and walls between the floor and ceiling to define an interior, said apparatus being adapted to lessen the temperature differential between said level interiors and comprising, in combination:

duct means having an inlet end and an outlet end, said duct means extending between said upper and lower levels and defining an air flow path between the upper and lower level interiors, said duct means inlet end being located at the upper level ceiling and communicating with said upper level interior, said duct means outlet end being in communication with said lower level interior;

first temperature sensing means for sensing the temperature of said lower level interior;

second temperature sensing means for sensing the temperature of said upper level interior;

air delivery means for delivering air between said upper level interior and said lower level interior through the flow path defined by said duct means, said air delivery means adapted to deliver air within said duct means from said duct means inlet end to said duct means outlet end; and control means for activating said air delivery means when a temperature differential of a predetermined magnitude is sensed by said first and second sensing means to deliver air between said upper level interior and said lower level interior.

2. The apparatus according to claim 1 wherein said air delivery means includes a fan in communication with the flow path defined by said duct means and a motor adapted to rotate said fan, said motor being operatively associated with said control means whereby said motor will be energized and said fan rotated upon activation of said air delivery means by said control means.

3. The apparatus according to claim 1 wherein said first temperature sensing means comprises a thermostat sensor mounted in said lower level interior adjacent said duct means outlet end and spaced from an airstream exiting from said duct mean outlet due to rotation of said fan.

4. The apparatus according to claim 1 wherein said control means comprises a differential temperature controller device.

5. The apparatus according to claim 1 wherein said second temperature sensing means comprises a thermostat sensor mounted at said duct means inlet end.

6. The apparatus according to claim 2 additionally comprising switch means for selectively bypassing said control means.

7. The apparatus of claim 1 additionally comprising air cleaning means disposed at said duct means inlet for filtering the air passing along said air flow path.

* * * * *